US010363198B2

(12) United States Patent
Salstein-Begley et al.

(10) Patent No.: US 10,363,198 B2
(45) Date of Patent: Jul. 30, 2019

(54) HAND-PRESSING HEADACHE-RELIEVING DEVICE

(71) Applicants: Karen Salstein-Begley, Miami, FL (US); Eitan Zohar, Davie, FL (US)

(72) Inventors: Karen Salstein-Begley, Miami, FL (US); Eitan Zohar, Davie, FL (US)

( * ) Notice: Subject to any disclaimer, the term of this patent is extended or adjusted under 35 U.S.C. 154(b) by 137 days.

(21) Appl. No.: 15/249,153

(22) Filed: Aug. 26, 2016

(65) Prior Publication Data

US 2017/0348191 A1 Dec. 7, 2017

Related U.S. Application Data

(60) Provisional application No. 62/210,307, filed on Aug. 26, 2015.

(51) Int. Cl.
*A61H 39/04* (2006.01)

(52) U.S. Cl.
CPC ..... *A61H 39/04* (2013.01); *A61H 2201/0192* (2013.01); *A61H 2201/165* (2013.01); *A61H 2201/1635* (2013.01); *A61H 2205/065* (2013.01)

(58) Field of Classification Search
CPC ..... A61H 39/04; A61H 2201/165; A61H 2201/0192; A61H 2201/1635; A61H 2205/065; A61H 39/00–086; A61F 5/30; A61F 5/32; A61F 5/34; A61F 5/24; A61F 5/26; A61F 5/28; A61F 2013/0028; A61F 2013/00468; A61B 17/132; A61B 17/1322; A61B 17/1325; A61B 17/1327
See application file for complete search history.

(56) References Cited

U.S. PATENT DOCUMENTS 3,595,225 A * 7/1971 Beeman ..... A61F 5/10 602/21
3,884,240 A * 5/1975 Gilman ..... A61B 17/132 2/209
4,294,237 A * 10/1981 Frazier ..... A61F 5/05866 602/21
4,479,495 A * 10/1984 Isaacson ..... A61F 13/06 606/204
4,549,536 A * 10/1985 Varjabedian ..... A61H 39/04 52/DIG. 10
4,592,342 A * 6/1986 Salmasian ..... A61F 5/0009 128/898
4,716,898 A * 1/1988 Chauve ..... A61H 39/04 601/134
4,787,379 A * 11/1988 Yeh ..... A61F 5/24 128/101.1
4,981,146 A * 1/1991 Bertolucci ..... A61H 39/002 128/907
5,078,728 A * 1/1992 Giarratano ..... A61H 39/04 606/201

(Continued)

*Primary Examiner* — Karina M Stransky
*Assistant Examiner* — Brigid K Byrd
(74) *Attorney, Agent, or Firm* — H. John Rizvi; John Rizvi, P.A.

(57) ABSTRACT

A headache-relieving device is provided including a device body having a first side, a second side and, preferably, a connecting portion connecting the second side to the first side. A hand space is formed between the first side and the second side allowing a user to insert his or her hand. A pressing element is provided on the second side. The pressing element is configured to apply pressure against a pressure point of a user's hand positioned in the hand space. The device provides an effective, drug-free and risk-free headache relieving device which is easy to carry and store, and can be conveniently and easily turned to in the event of a headache.

19 Claims, 6 Drawing Sheets

(56) References Cited

U.S. PATENT DOCUMENTS 5,234,459 A * 8/1993 Lee ..... A61B 17/135 606/202
5,269,803 A * 12/1993 Geary ..... A61B 17/1322 606/201
5,295,996 A * 3/1994 Blair ..... A61B 17/1325 128/119.1
5,350,418 A * 9/1994 Janevski ..... A61F 5/0118 602/21
5,366,475 A * 11/1994 Voss ..... A61H 39/04 606/204
5,405,310 A * 4/1995 Yoo ..... A61H 39/04 601/134
5,468,220 A * 11/1995 Sucher ..... A61F 5/05866 2/170
5,470,304 A * 11/1995 Decanto ..... A61H 7/001 601/134
5,547,462 A * 8/1996 Lanigan ..... A61F 5/028 128/876
5,662,679 A * 9/1997 Voss ..... A61H 39/04 606/151
5,667,484 A * 9/1997 Brossard ..... A43B 7/146 602/21
5,695,520 A * 12/1997 Bruckner ..... A61B 17/1325 606/201
5,709,647 A * 1/1998 Ferber ..... A61H 39/04 601/134
5,919,151 A * 7/1999 Gustafson ..... A61F 5/32 128/878
6,077,242 A * 6/2000 Falk ..... A61F 5/0109 602/26
6,189,538 B1 * 2/2001 Thorpe ..... A61B 17/1325 128/898
6,217,536 B1 * 4/2001 Gustafson ..... A61F 5/32 128/879
6,361,549 B1 * 3/2002 Asatourian ..... A61F 5/0104 606/204
6,398,749 B1 * 6/2002 Slautterback ..... A61F 13/102 128/881
6,755,800 B2 * 6/2004 Weaver, II ..... A61F 13/108 128/112.1
6,986,779 B2 * 1/2006 Begley ..... A61H 39/04 601/148
7,780,612 B2 * 8/2010 Ross ..... A61F 5/28 128/121.1
D623,306 S * 9/2010 Boyer ..... D24/106
7,887,497 B2 * 2/2011 Weber ..... A61F 5/0118 128/878
8,109,963 B1 * 2/2012 Korrol ..... A61H 39/04 606/204
8,708,991 B2 * 4/2014 Turner ..... A61F 13/00021 602/43
9,439,827 B2 * 9/2016 Saatchi ..... A61B 17/1325
D796,686 S * 9/2017 Internicola ..... D24/200
2003/0018286 A1 * 1/2003 Porrata ..... A61F 5/0118 602/21
2003/0055453 A1 * 3/2003 Akerfeldt ..... A61B 17/135 606/203
2003/0130604 A1 * 7/2003 Porrata ..... A61F 5/0118 602/21
2004/0158284 A1 * 8/2004 Son ..... A61H 39/04 606/201
2004/0254505 A1 * 12/2004 Begley ..... A61H 39/04 601/1
2005/0113866 A1 * 5/2005 Heinz ..... A61B 17/1322 606/203
2005/0267518 A1 * 12/2005 Wright ..... A61B 17/132 606/203
2006/0020237 A1 * 1/2006 Nordt, III ..... A61F 5/0118 602/60
2006/0095072 A1 * 5/2006 TenBrink ..... A61B 17/1322 606/201
2006/0118679 A1 * 6/2006 Delgado ..... A61F 5/0118 248/118
2006/0190026 A1 * 8/2006 Sanders ..... A61H 39/04 606/204
2007/0093867 A1 * 4/2007 Savoia ..... A61H 39/04 606/204
2007/0198055 A1 * 8/2007 Schouten ..... A61H 39/04 606/204
2007/0239092 A1 * 10/2007 Ross ..... A61F 5/28 602/20
2008/0262479 A1 * 10/2008 Barela ..... A61B 5/01 606/1
2008/0319473 A1 * 12/2008 Rosenbaum ..... A61B 17/1325 606/201
2009/0082793 A1 * 3/2009 Birk ..... A61F 5/003 606/157
2009/0177129 A1 * 7/2009 Chan ..... A61H 23/0254 601/112
2009/0182387 A1 * 7/2009 Liu ..... A41D 19/00 607/1
2009/0198152 A1 * 8/2009 Kim ..... A61B 17/132 600/583
2009/0292228 A1 * 11/2009 Van Kuren ..... A61H 7/001 601/84
2010/0042031 A1 * 2/2010 Anglada ..... A61F 5/30 602/20
2010/0042138 A1 * 2/2010 Duelo Riu ..... A61H 7/006 606/204
2010/0085844 A1 * 4/2010 Lee ..... A61H 39/002 368/250
2010/0280541 A1 * 11/2010 Lampropoulos ... A61B 17/1325 606/203
2011/0028934 A1 * 2/2011 Buckman ..... A61B 17/135 604/385.12
2011/0144551 A1 * 6/2011 Johnson ..... A61F 5/028 602/19
2011/0178360 A1 * 7/2011 Gavish ..... A61H 39/04 600/15
2012/0191127 A1 * 7/2012 Guillot ..... A61B 17/1325 606/203
2012/0221041 A1 * 8/2012 Hansson ..... A61B 17/1325 606/203
2012/0259255 A1 * 10/2012 Tomlinson ..... A61H 3/00 601/46
2013/0110019 A1 * 5/2013 Hopman ..... A61B 17/135 602/13
2013/0304112 A1 * 11/2013 Ting ..... A61B 5/021 606/203
2013/0310717 A1 * 11/2013 Ranky ..... A61H 1/0288 601/40
2013/0333706 A1 * 12/2013 Bauerfeind ..... A61F 5/0193 128/845
2014/0012174 A1 * 1/2014 Wu ..... A61F 13/0223 602/53
2014/0188024 A1 * 7/2014 Cox ..... A61F 5/01 602/20
2014/0276600 A1 * 9/2014 Foster ..... A61M 5/425 604/507
2015/0119926 A1 * 4/2015 Saatchi ..... A61B 17/1325 606/202
2015/0224025 A1 * 8/2015 Darna ..... A61H 39/04 606/204
2015/0320637 A1 * 11/2015 Henre ..... A61H 15/00 601/132
2016/0045203 A1 * 2/2016 Pollock ..... A61B 17/132 606/204
2016/0066925 A1 * 3/2016 van Sparrentak .... A61B 17/132 606/203
2016/0324674 A1 * 11/2016 Scheuermann ..... A61F 5/0106
2017/0042764 A1 * 2/2017 Tima ..... A61H 39/04
2017/0326027 A1 * 11/2017 Moore ..... A61H 39/04

* cited by examiner

HAND-PRESSING HEADACHE-RELIEVING DEVICE

CROSS-REFERENCE TO RELATED APPLICATIONS

This application claims the benefit of U.S. Provisional Patent Application Ser. No. 62/210,307, filed Aug. 26, 2015, which is incorporated herein by reference in its entirety.

FIELD OF THE INVENTION

The present invention relates generally to headache-relieving devices and methods, and more particularly, to a headache-relieving device which is attached to the hand and can apply pressure to a pressure point on the hand between the thumb and index finger of a user to relieve headaches.

BACKGROUND OF THE INVENTION

A headache, or cephalalgia, is pain in the head or neck that can be a symptom of any of various conditions of the head and neck. Headaches can be caused by disturbance of pain-sensitive structures around the brain, due for instance to fatigue, sleep deprivation, stress, the effects of medications and recreational drugs, viral infections, common colds, head injury, rapid ingestion of cold foods or beverages, dental work or sinus issues. Headaches are one of the most commonly experienced of all types of physical discomforts.

In the medical field, a number of different classification systems for headaches are currently used. For instance, headaches are broadly classified as "primary" or "secondary". Primary headaches are benign, recurrent headaches which are not caused by underlying disease or structural problems. A migraine headache is a type of primary headache. Primary headaches may cause significant daily pain and disability. Secondary headaches are caused by an underlying disease such as an infection, head injury, vascular disorders, brain bleed or tumors.

Treatment of headaches commonly involves the use of painkillers. However, many potential users of painkillers may be allergic to the painkillers and thus, unable to use them for relief. Furthermore, long-term use of some painkillers may have deleterious effects on health.

Accordingly, there is an established need for a headache-relieving device which can be drug-free and is easily and conveniently usable by a person in order to relieve their headache.

SUMMARY OF THE INVENTION

The present invention is directed to a hand-pressing, headache-relieving device which is worn on a hand of a user and can apply pressure on a pressure point on the hand to relieve headaches. The device provides an effective, convenient, easy-to-use and drug-free way of treating headaches. The headache-relieving device includes a device body having a first side, a second side and, preferably, a connecting portion connecting the second side to the first side. A hand space is formed between the first side and the second side. A pressing element is provided on the second side. The headache-relieving device can be applied to the hand of a user who suffers from headache by inserting the hand of the user in the hand space. The pressing element can be positioned over a pressure point typically between the thumb and index finger on the user's hand and, preferably, can be tightened against the pressure point to relieve the user's headache.

In a first implementation of the invention, a headache-relieving device includes a device body and a pressing element. The device body has a first side and a second side arranged in a spaced-apart relationship with one another, thereby delimiting a hand space therebetween. The pressing element, in turn, is provided on the second side of the device body and protrudes into the hand space of the device body. The pressing element is configured to apply pressure against a pressure point on a user's hand positioned in the hand space.

In a second aspect, the device body can be flexible and the hand space is size adjustable, to facilitate lacing the device body on a hand. In some embodiments, the device body can be elastically deformable, such as to recover a more opened position after ceasing a compression force which brings the first and second sides of the device body together to adjust to the hand. In other embodiments, the device body can be plastically deformable, to remain opened or closed as set by the user.

In another aspect, the device can further include at least one strap connecting the first side and the second side of the device body, to secure the device body to the user's hand.

In another aspect, the connecting strap can include two opposite ends, each end attached to a corresponding one of the first side and second side of the device body. In some embodiments, at least one of the ends is non-disconnectably attached to the corresponding one of the first side and second side of the device body. In other embodiments, at least one of the ends is disconnectably attached to the corresponding one of the first side and second side of the device body.

In yet another aspect, the at least one strap can extend through registering first and second strap slots in the first side and the second side of the device body, respectively, reducing the footprint of the device on the user's hand.

In another aspect, the device body can further include a connecting portion connected to the first side and the second side of the device body forming a C-shape, to embrace a side of the user's hand and more snugly adjust to the hand to guarantee pressure is exerted on the pressure point. In some embodiments, the first side, second side and connecting portion are formed into a single-piece unit. At least one length-adjustable connecting member (e.g., a strap) can connect the second side to the first side of the C-shaped device body.

In another aspect, the pressing element can be adjustable to vary a protrusion depth of the pressing element into the hand space and thus vary the pressure of the pressing element against the pressure point in the user's hand. In some embodiments, the pressing element can be threaded into a pressing element opening on the second side of the device body, and the pressing element can be adjusted by selectively threading or unthreading the pressing element into or from the pressing element opening. Optionally, the pressing element can include a pressing element knob arranged on an outer side of the second side of the device body, and a pressing element shaft extending from the pressing element knob and through the pressing element opening in the second side of the device body. A tip of the pressing element shaft can protrude into the hand space to apply pressure against the pressure point on the user's hand positioned in the hand space. The tip can be rounded.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a headache-relieving device which is attached to a user's hand and can apply pressure to a pressure point on the hand between the thumb and index finger of the user to relieve headaches. The headache-relieving device does not require drugs to relieve a person's headaches and can thus provide a drug-free and risk-free treatment of headaches. In addition, the user can normally operate and function with his hand while treating their headache.

Figure 1:
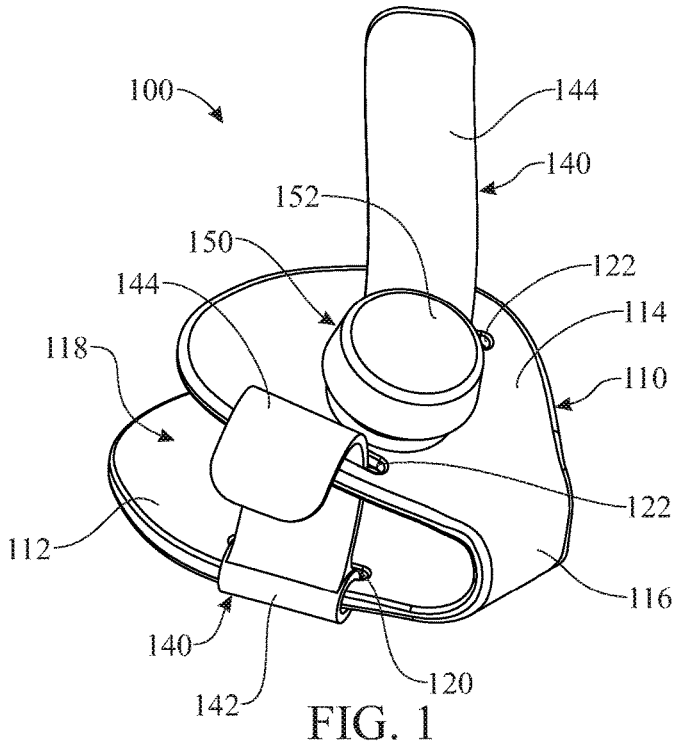
FIG. 1 is a first perspective view of an illustrative embodiment of the headache-relieving device in accordance with the invention.
Figure 4:
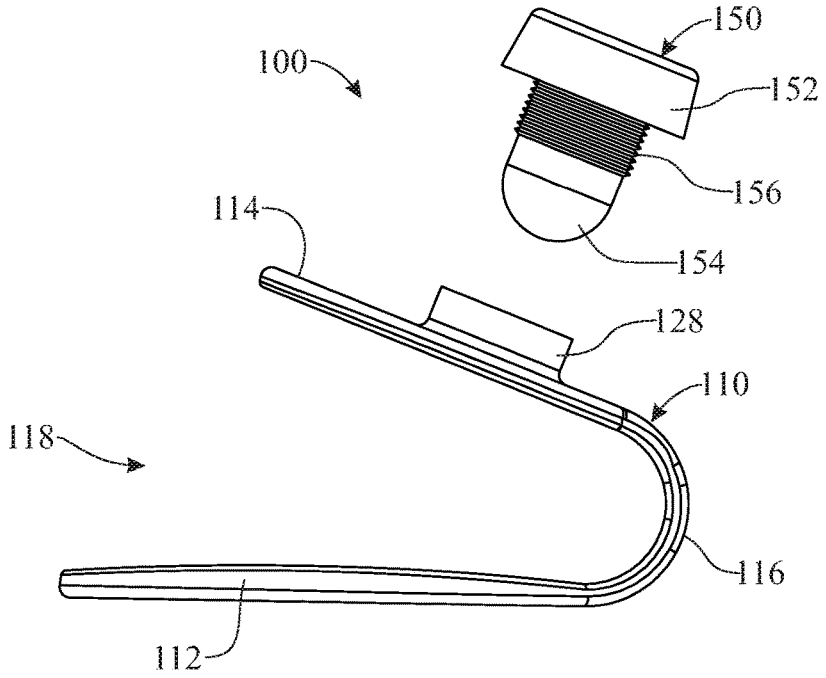
FIG. 4 is an exploded side elevation view of the headache-relieving device of FIG. 1, with the connecting straps removed for brevity.
Figure 5:
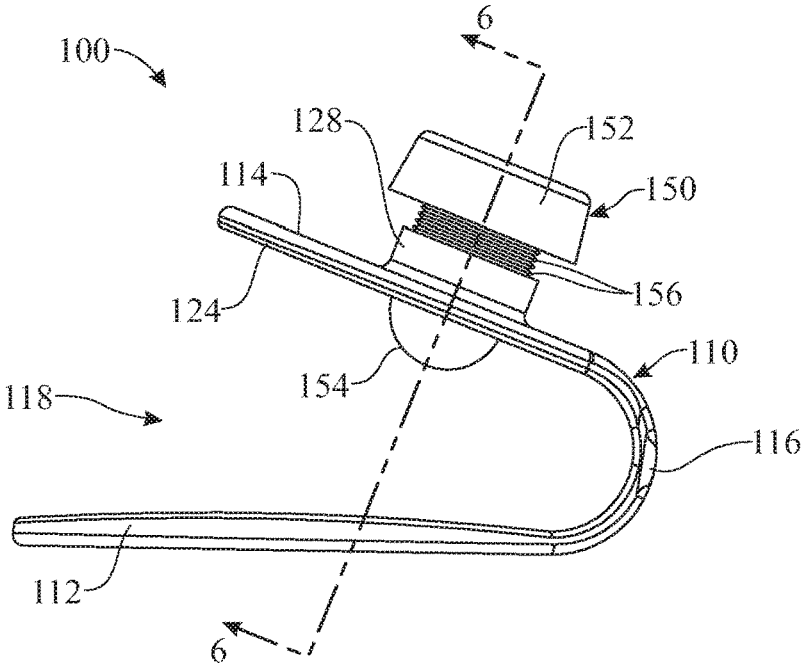
FIG. 5 is a side elevation view of the headache-relieving device of FIG. 1, with the connecting straps removed for brevity.

Referring initially to FIG. 1, a headache-relieving device 100 is illustrated in accordance with an exemplary embodiment of the present invention. The headache-relieving device 100 includes a device body 110. The device body 110 may be fabricated of neoprene, plastic, rubber and/or other preferably flexible material. As illustrated in FIG. 4, the device body 110 may be generally C-shaped in side view and may include a first side 112, a second side 114 and a generally curved and flexible or adjustable connecting portion 116 which connects the second side 114 to the first side 112 thereby forming a C-shape. Preferably, as shown, the first side 112, second side 114 and connecting portion 116 are formed into a single-piece unit, such as made of plastic, rubber or the like and manufactured by injection molding. The first side 112 and second side 114 are spaced apart, a hand space 118 being delimited by and formed between the first side 112 and the second side 114. The hand space 118 is adjustable, such as by the connecting portion 116 being flexible and adjustable to allow varying the distance between the first side 112 and the second side 114. Alternatively or additionally, the first side 112 and second side 114 can be flexible and/or flexibly attached to the connecting portion 116. In general, any part of, or the entire C-shaped device body 110 can be flexible to allow for an adjustment of the hand space 118 to a user's hand.

In some embodiments, at least one connecting member may further connect the second side 114 to the first side 112 of the device body 110. The connecting member may include at least one connecting strap 140. In some embodiments, such as the illustrated embodiment, a pair of connecting straps 140 may connect the second side 114 to the first side 112 on respective sides of the connecting portion 116.

Figure 2:
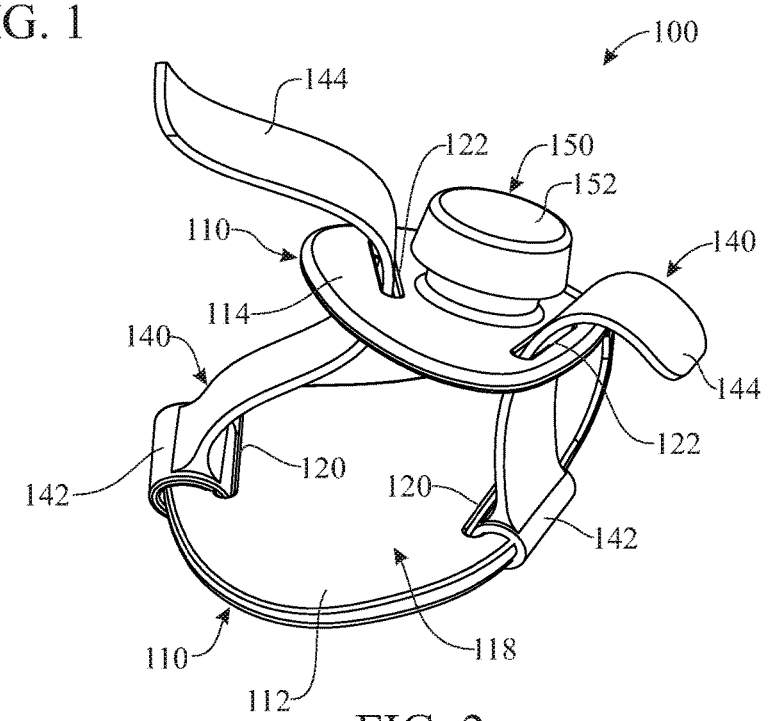
FIG. 2 is a second perspective view of the headache-relieving device of FIG. 1.

As best shown in FIG. 2, each connecting strap 140 may have a fixed end portion 142 which is permanently or non-disconnectably attached to one of the first side 112 and second side 114, and an elongated, flexible connecting strap body 144 which extends from the fixed end portion 142. At least one pair of a first strap slot 120 and a second strap slot 122 may extend through the first side 112 and the second side 114, respectively. Accordingly, the fixed end portion 142 of the connecting strap 140 may extend through the first strap slot 120 in the first side 112 or, in alternative embodiments, through the second strap slot 122 in the second side 114; in the present embodiment, more specifically, the fixed end portion 142 of the connecting strap 140 is looped through the first strap slot 120 and is permanently or non-disconnectably attached to the first side 112. The connecting strap body 144 of the connecting strap 140, in turn, may extend through a remaining, registering second strap slot 122 or first strap slot 120 in the other side, i.e. the second side 114 or first side 112 of the device body 110; for instance, in the present embodiment, the connecting strap body 144 extends through the second strap slot 122 in the second side 114 of the device body 110 on the same side of the C-shaped device body 110 on which the fixed end portion 142 is attached. The connecting strap body 144 may be looped around and attached to the fixed end portion 142 of the connecting strap 140 and/or to the remainder of the connecting strap body 144 via hook and loop fasteners, snaps and/or other disconnectably-attachable attachment mechanism known by those skilled in the art.

In some embodiments, the connecting strap body 144 of at least one connecting strap 140 may be length-adjustable using buckles, hook and loop fasteners and/or alternative adjusting techniques known by those skilled in the art, to allow the user to adjust the tightness of the connecting strap 140 to his/her desire. In some embodiments, the connecting strap body 144 of at least one connecting strap 140 can be elastic, such as made of or comprising rubber, an elastic fabric, or the like, allowing the connecting strap 140 to automatically adjust to the user's hand.

Figure 3:
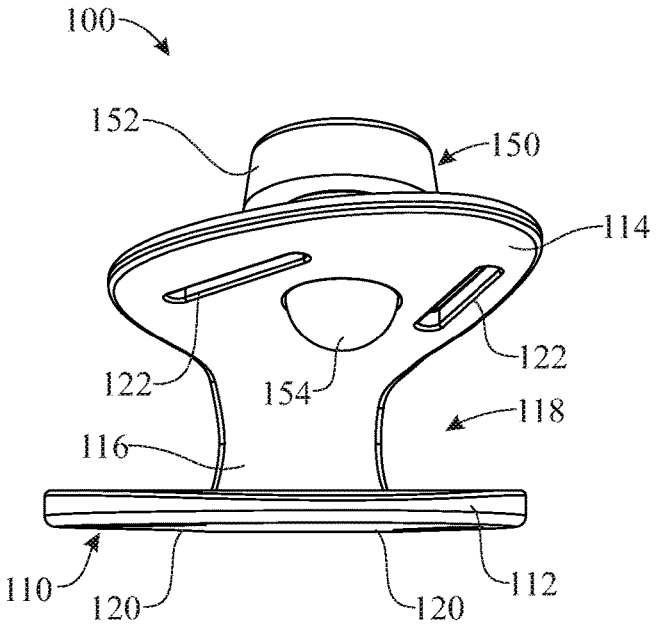
FIG. 3 is a front elevation view of the headache-relieving device of FIG. 1, with the connecting straps removed for brevity.

As shown in FIGS. 1 and 2, a pressing element 150 may be provided on the second side 114 of the device body 110. As best shown in FIGS. 3 and 4, the pressing element 150 can protrude from an inner surface 124 into the hand space 118. Preferably, the pressing element 150 is movable with respect to the second side 114 in order to allow for adjustment of the protruding depth from the inner surface 124. For instance, the pressing element 150 depicted herein is threaded to the second side 114 and can be threaded or unthreaded by the user in order to vary the depth of protrusion of the pressing element 150 into the hand space 118.

Figure 6:
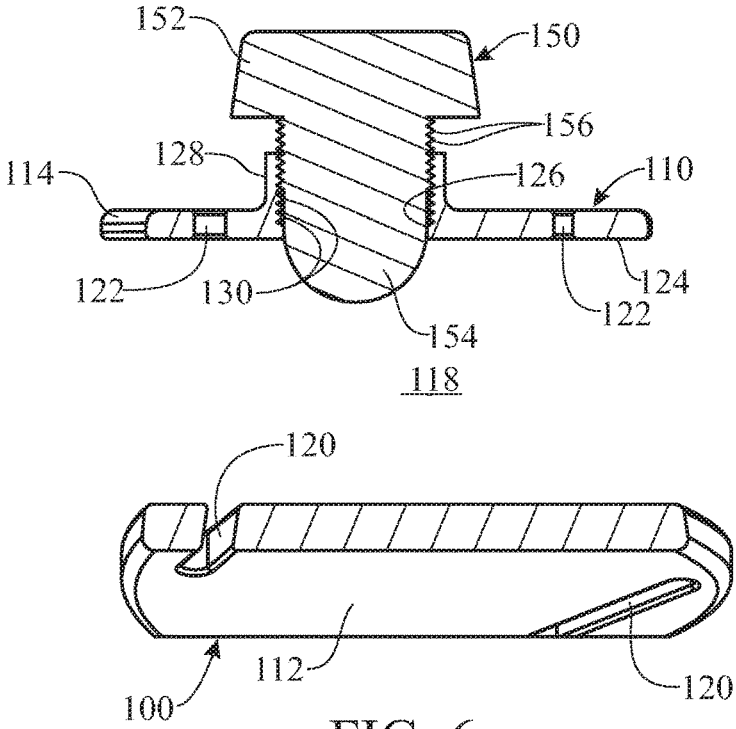
FIG. 6 is a cross-sectional view of the headache-relieving device of FIG. 1, with the connecting straps removed for brevity, taken along section line 6-6 shown in FIG. 5.
Figure 9:
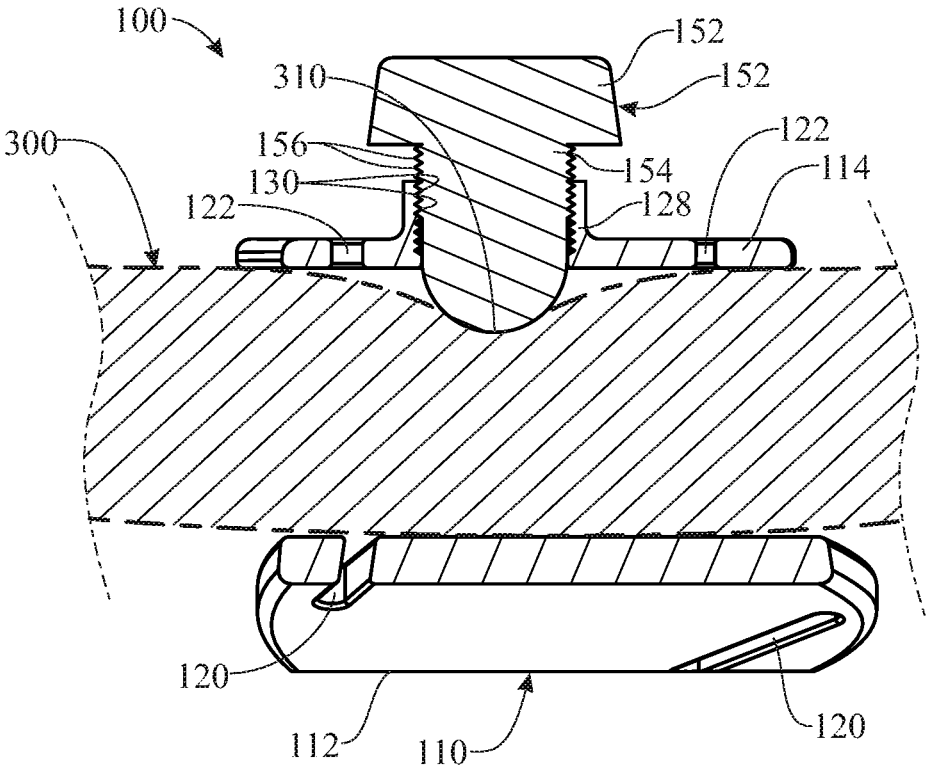
FIG. 9 is a cross-sectional view of the headache-relieving device of FIG. 1 applied to the hand of the user.

As illustrated in FIG. 6, in some embodiments, the pressing element 150 may include a pressing element knob 152. A pressing element shaft 154 may extend from the pressing element knob 152. Pressing element threads 156 may be provided on an exterior surface of the pressing element shaft 154. As illustrated in FIGS. 6 and 9, the distal end of the pressing element shaft 154 may be rounded or blunted. A pressing element opening 126 may extend through the second side 114 in communication with the hand space 118. In some embodiments, a pressing element collar 128 may protrude from the second side 114 in concentric relationship to the pressing element opening 126. Pressing element opening threads 130 may be provided on an interior surface of the pressing element opening 126 and/or the pressing element collar 128. In the present embodiment, both the pressing element opening 126 and the pressing element collar 128 are threaded. Accordingly, the pressing element shaft 154 may threadably engage the pressing element opening 126 and the pressing element collar 128. The pressing element knob 152 can be selectively rotated in a clockwise or counterclockwise direction to advance the pressing element shaft 154 into the hand space 118 and in an opposite counterclockwise or clockwise direction, respectively, to retract the pressing element shaft 154 from the hand space 118 for purposes which will be hereinafter described.

Figure 7:
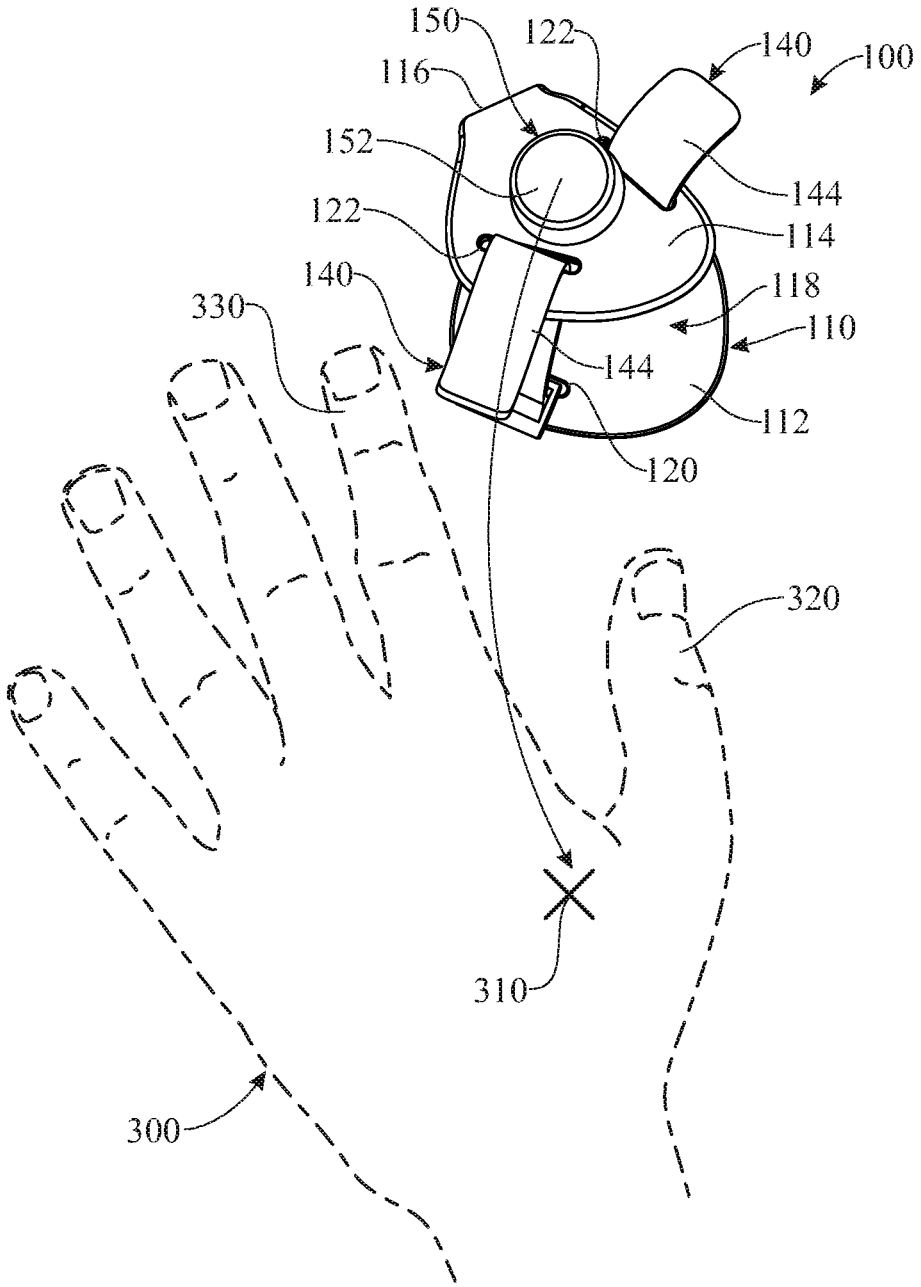
FIG. 7 is a top perspective view of the headache-relieving device of FIG. 1, more particularly illustrating application of the device to the hand (illustrated in phantom) of a user in typical application of the device.
Figure 8:
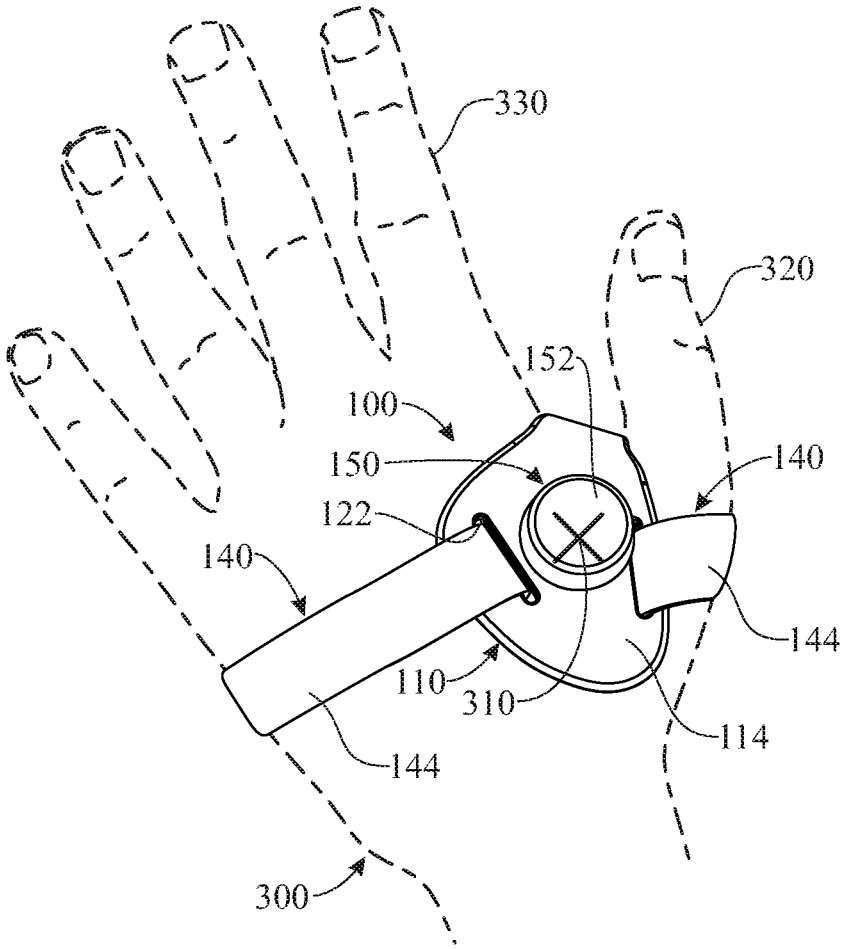
FIG. 8 is a top perspective view of the headache-relieving device of FIG. 1 applied to the hand of the user.

As illustrated in FIGS. 7 through 9, in typical application, the headache-relieving device 100 is placed on the hand 300 of a user who is suffering from a headache. In some embodiments, the flexible device body 110 can be slightly opened to facilitate insertion and fitting onto the hand 300. The connecting strap body 144 of each connecting strap 140 may be selectively length-adjusted to facilitate movement of the second side 114 away from the first side 112 and selective enlargement of the hand space 118 for placement of the user's hand 300 in the hand space 118. The hand 300 is placed in the hand space 118 between the first side 112 and the second side 114 of the device body 110, with the tip of the pressing element shaft 154 of the pressing element 150 positioned in registration with a pressure point 310 between the thumb 320 and index finger 330 on the hand 300. In some embodiments, once set place, the device body 110 may be elastically deformable, and allowed to recover a more closed position to snugly but comfortably adjust to the hand 300; in other embodiments, the device body 110 may be plastically deformable and the user may deform the device body 110 to a desired adjustment on the hand 300; in further alternative embodiments, the device body 110 may not be flexible or deformable. Once the device body 110 is fitted onto the hand 300 so that the tip of the pressing element shaft 154 is positioned in registration with the pressure point 310, the connecting straps 140 may then be tightened and/or fastened typically according to the preference of the user, to secure the C-shaped device body 110 onto the hand 300 and maintain the tip of the pressing element shaft 154 in registration with the pressure point 310. The pressing element knob 152 may then be rotated (typically in a clockwise direction) to advance the pressing element shaft 154 against the pressure point 310 and cause the pressing element shaft 154 to press the pressure point 310 as shown in FIG. 9. The tightness of the pressing element shaft 154 against the pressure point 310 may be selectively varied by rotation of the pressing element knob 152, in accordance with user preference, the magnitude of the headache, or any applicable factor. The headache-relieving device 100 can be maintained in place on the hand 300, or intermittently removed from the hand 300 and re-applied, as necessary, to reduce the magnitude of the headache or eliminate the headache.

Figure 10:
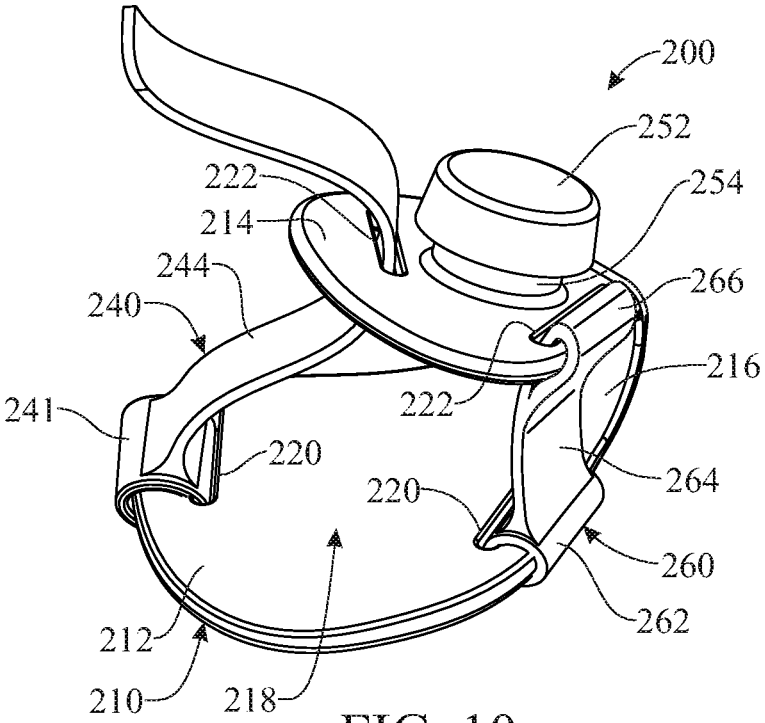
FIG. 10 is a perspective view of an alternative illustrative embodiment of the headache-relieving device according to the invention.

Referring next to FIG. 10, an alternative illustrative embodiment of the headache-relieving device is generally indicated by reference numeral 200. Like features of the headache-relieving device 200 and the headache-relieving device 100 (FIGS. 1 through 9) are numbered the same except preceded by the numeral '2'.

The headache-relieving device 200 shown in FIG. 10 includes a first connecting strap 240 which is the same as or similar to that of the headache-relieving device 100. The headache-relieving device 200 includes a second connecting strap 260 having a first fixed end portion 262 connected to the corresponding first strap slot 220 which extends through the first side 212 of the device body 210, and an elongated connecting strap body 264 extending from the fixed end portion 262. Unlike the first embodiment, however, the second connecting strap 260 further includes an opposite second fixed end portion 266 which extends through the second strap slot 222 in the second side 214 of the device body 210 and is permanently or fixedly formed in the connecting strap body 264 and permanently affixed to the second side 214, similarly to the first fixed end portion 262. In some embodiments, the connecting strap body 264 of the second connecting strap 260 may be selectively length-adjustable and/or elastic. In other embodiments, the length of the connecting strap body 264 may be fixed.

Further alternative embodiments are contemplated in which both ends of one or both connecting straps are non-permanently attached to the device body, and can be disconnected from the device body. In some embodiments, one or both connecting straps are entirely removable from the device body, for instance to facilitate washing the connecting straps and/or the device body, or to allow replacing either one of the connecting straps or the device body.

With continued reference to FIG. 10, application of the headache-relieving device 200 may be as was heretofore described with respect to the headache-relieving device 100 of FIGS. 1-9. The connecting strap body 244 of the first connecting strap 240 may be selectively length-adjustable and/or detachable with respect to the second side 214 to facilitate selective enlargement of the hand space 218 for placement of the user's hand 300 in the hand space 218. The pressing element 250 is then adjusted onto the pressure point 310 by selective user operation of the pressing element knob 252 with the other hand (not shown), or by a person assisting the user.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A hand-pressing headache-relieving device, comprising:

a C-shaped device body having a first side and a second side arranged in a spaced-apart relationship with one another and connected to one another by a connecting portion, the C-shaped body delimiting a hand space therewithin;

a pressing element provided on the second side and protruding into the hand space of the device body, the pressing element configured to apply pressure against a pressure point on a user's hand positioned in the hand space; and at least one strap connecting the first side and the second side of the device body on at least one side of the connecting portion.

2. The device of claim 1, wherein the device body is flexible and the hand space is size adjustable.

3. The device of claim 2, wherein the device body is elastically deformable.

4. The device of claim 2, wherein the device body is plastically deformable.

5. The device of claim 1, wherein the at least one strap comprises two straps arranged on opposite sides of the connecting portion, each strap connecting the first side and the second side of the device body.

6. The device of claim 1, wherein the connecting strap comprises two opposite ends, each end attached to a corresponding one of the first side and second side of the device body.

7. The device of claim 6, wherein at least one of the ends is non-disconnectably attached to the corresponding one of the first side and second side of the device body.

8. The device of claim 6, wherein at least one of the ends is disconnectably attached to the corresponding one of the first side and second side of the device body.

9. The device of claim 1, wherein the at least one strap extends through registering first and second strap slots in the first side and the second side of the device body, respectively.

10. The device of claim 1, wherein the first side, second side and connecting portion are formed into a single-piece unit.

11. The device of claim 10, further comprising at least one length-adjustable connecting member connecting the second side to the first side in addition to the connecting portion.

12. The device of claim 11, wherein the at least one connecting member comprises a strap.

13. The device of claim 1, wherein the pressing element is adjustable to vary a protrusion depth of the pressing element into the hand space.

14. The device of claim 13, wherein the pressing element is threaded into a pressing element opening on the second side of the device body, and the pressing element is adjustable to vary the protrusion depth of the pressing element into the hand space by selectively threading or unthreading the pressing element into or from the pressing element opening.

15. The device of claim 14, wherein the pressing element comprises a pressing element knob arranged on an outer side of the second side of the device body, and a pressing element shaft extending from the pressing element knob and through the pressing element opening in the second side of the device body.

16. The device of claim 15, wherein a tip of the pressing element shaft protrudes into the hand space and is configured to apply pressure against the pressure point on the user's hand positioned in the hand space.

17. The device of claim 16, wherein the tip is rounded.

18. A headache-relieving device, comprising:

a C-shaped device body having a first side and a second side arranged in a spaced-apart relationship with one another and connected to one another by a connecting portion, the C-shaped body delimiting a hand space therewithin;

a pressing element configured to apply pressure against a pressure point on a user's hand positioned in the hand space, wherein the pressing element is threaded into a pressing element opening on the second side and protrudes into the hand space of the device body, and further wherein the pressing element is adjustable to vary a protrusion depth of the pressing element into the hand space by selectively threading or unthreading the pressing element into or from the pressing element opening; and at least one strap connecting the first side and the second side of the device body on at least one side of the connecting portion.

19. A headache-relieving device, comprising:

a C-shaped device body having a first side, a second side and a connecting portion, wherein the first and second sides are arranged in a spaced-apart relationship with one another, and further wherein the connecting portion is connected to the first side and the second side of the device body, the C-shaped body delimiting a hand space therewithin;

a user-operable pressing element configured to apply pressure against a pressure point on a user's hand positioned in the hand space, wherein the pressing element is threaded into a pressing element opening on the second side and protrudes into the hand space of the device body, and further wherein the pressing element is adjustable to vary a protrusion depth of the pressing element into the hand space by selectively and manually threading or unthreading the pressing element into or from the pressing element opening; and at least one strap connecting the first side and the second side of the device body on at least one side of the connecting portion.

* * * * *